US007283103B2

(12) United States Patent
Wangsvick et al.

(10) Patent No.: US 7,283,103 B2
(45) Date of Patent: Oct. 16, 2007

(54) COMPACT BROADBAND ANTENNA

(75) Inventors: Chad M. Wangsvick, Tucson, AZ (US); Gary M. Salvail, Camarillo, CA (US); Joseph A. Robson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 165 days.

(21) Appl. No.: 10/838,549

(22) Filed: May 4, 2004

(65) Prior Publication Data

US 2007/0188394 A1 Aug. 16, 2007

(51) Int. Cl.
*H01Q 13/00* (2006.01)
*H01Q 9/28* (2006.01)
*H01Q 1/48* (2006.01)

(52) U.S. Cl. ..... 343/775; 343/808; 343/846

(58) Field of Classification Search ..... 343/700 MS, 343/772, 775, 808, 846
See application file for complete search history.

(56) References Cited

U.S. PATENT DOCUMENTS 2,239,700 A * 4/1941 Carter ..... 343/807
3,401,387 A * 9/1968 Milligan et al. ..... 343/767
3,414,903 A * 12/1968 Bartlett et al. ..... 343/753
3,978,486 A * 8/1976 Reinders ..... 343/781 CA
4,719,470 A * 1/1988 Munson ..... 343/700 MS
5,506,592 A * 4/1996 MacDonald et al. ..... 343/846
5,990,845 A * 11/1999 Sharp et al. ..... 343/846
6,198,454 B1 * 3/2001 Sharp et al. ..... 343/773
6,697,031 B2 * 2/2004 Jocher ..... 343/895
6,842,141 B2 * 1/2005 Suh et al. ..... 343/700 MS
7,006,047 B2 * 2/2006 Marsan et al. ..... 343/705

FOREIGN PATENT DOCUMENTS

JP 10150318 A 6/1998

OTHER PUBLICATIONS

Eskelinen, Pekka, Improvements of an inverted trapazoidal pulse antenna, IEEE Antennas and Propagation Magazine, vol. 43, No. 3, Jun. 2001.

* cited by examiner

*Primary Examiner*—Shih-Chao Chen
(74) *Attorney, Agent, or Firm*—Rene Grossman, Esq.; Leonard A. Alkov Esq.; H. St. Julian, Esq.

(57) ABSTRACT

A compact broadband antenna. The antenna includes a first mechanism for receiving input electromagnetic energy. A second mechanism provides radiated electromagnetic energy upon receipt of the input electromagnetic energy. The radiated electromagnetic energy is provided via an antenna element having one or more angled surfaces. A third mechanism directs the radiated electromagnetic energy in a specific direction. In a more specific embodiment, the third mechanism includes a reflective backstop that is selectively positioned behind the second mechanism to reflect back-radiated energy forward of the second mechanism, thereby causing reflected electromagnetic energy to combine in phase with forward-radiated energy from the second mechanism. The third mechanism further includes plural layers of dielectric material. One or more of the plural layers of dielectric material partially surround an angled radiating surface of the second mechanism, which is implemented via a substantially conical transmit element in the specific embodiment.

37 Claims, 6 Drawing Sheets

COMPACT BROADBAND ANTENNA

This invention was made with Government support under Contract No. N00024-96-C-5204 ERGM. The Government may have certain rights in this invention.

BACKGROUND OF THE INVENTION

1. Field of Invention

This invention relates to antennas. Specifically, the present invention relates to systems and methods for selectively directing or receiving a beam of energy.

2. Description of the Related Art

Systems for directing beams of energy are employed in various demanding applications including microwave, radar, ladar, laser, infrared, and sonar sensing and targeting systems. Such applications demand space-efficient and cost-effective receivers and antennas with sufficient gain and bandwidth characteristics for optimal sensing.

Efficient and accurate systems for directing electromagnetic energy are particularly important in projected munition guidance and fusing applications, where collateral damage must be avoided. Smart munitions, such as a smart artillery shells, often incorporate electronics and accompanying fuses to time munition detonation. Such electronics may include sensors for detecting target location and selectively triggering detonation when the munition is within a predetermined range of the target. The sensors may include directional antennas, often called end-fire antennas, which aim beams of electromagnetic energy forward of the projected munitions. The directed beams may reflect from targets, yielding return beams. Sensors may detect and time target return beams to determine target range and closing rate.

Unfortunately, various conventional antennas, such as doorstop, patch, and monopole antennas have various shortcomings, making their use in projected munition applications problematic. Doorstop antennas are often too large to efficiently incorporate into compact munition designs. Patch antennas often insufficiently direct electromagnetic energy and exhibit undesirable bandwidth constraints. Monopole antennas often lack sufficient gain or bandwidth characteristics.

Hence, a need exists in the art for a compact and efficient antenna that exhibits excellent beam-directing, bandwidth, and gain characteristics and that is suitable for munitions applications.

SUMMARY OF THE INVENTION

The need in the art is addressed by the compact broadband antenna of the present invention. In the illustrative embodiment, the antenna is an end-fire antenna adapted for use in munitions applications. The antenna includes a first mechanism for receiving input electromagnetic energy. A second mechanism provides radiated electromagnetic energy upon receipt of the input electromagnetic energy. The radiated electromagnetic energy is provided via an antenna element having one or more angled surfaces. A third mechanism directs the radiated electromagnetic energy in a specific direction.

In a more specific embodiment, the third mechanism includes a reflective backstop that is strategically positioned behind the second mechanism to reflect back-radiated energy forward of the second mechanism, thereby causing reflected electromagnetic energy to combine in phase with forward-radiated energy from the second mechanism. The third mechanism further includes plural layers of dielectric material. One or more of the plural layers of dielectric material partially surround an angled radiating surface of the second mechanism.

In the specific embodiment, the second mechanism includes a conical antenna element. The longitudinal axis of the antenna element is approximately parallel to the surface of the back-reflector. The conical antenna element is supported by and partially surrounded by first a layer of dielectric material. A top portion of the conical antenna element lacks dielectric material. The first mechanism includes an antenna feed having an input stripline transmission line that is coupled to a coaxial feed transmission line or wire, which is coupled to a vertex of the conical antenna element.

The stripline transmission line includes a center conductor having a tapered section. A dielectric material having mode-suppression holes therethrough, is positioned between a top ground plane and a bottom ground plane, which have corresponding antenna tuning holes, of the stripline transmission line. The dielectric material accommodates a stripline center conductor. A second dielectric layer is positioned between the top ground plane and the first dielectric layer.

The novel design of the present invention is facilitated by the second and third mechanisms, which enable a compact, high-gain, antenna with broadband performance. An embodiment of the present invention, wherein the second mechanism includes a substantially conical transmit element, and the third mechanism includes a back-reflector, is particularly efficient for end-fire applications that must withstand significant acceleration and thermal loads.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
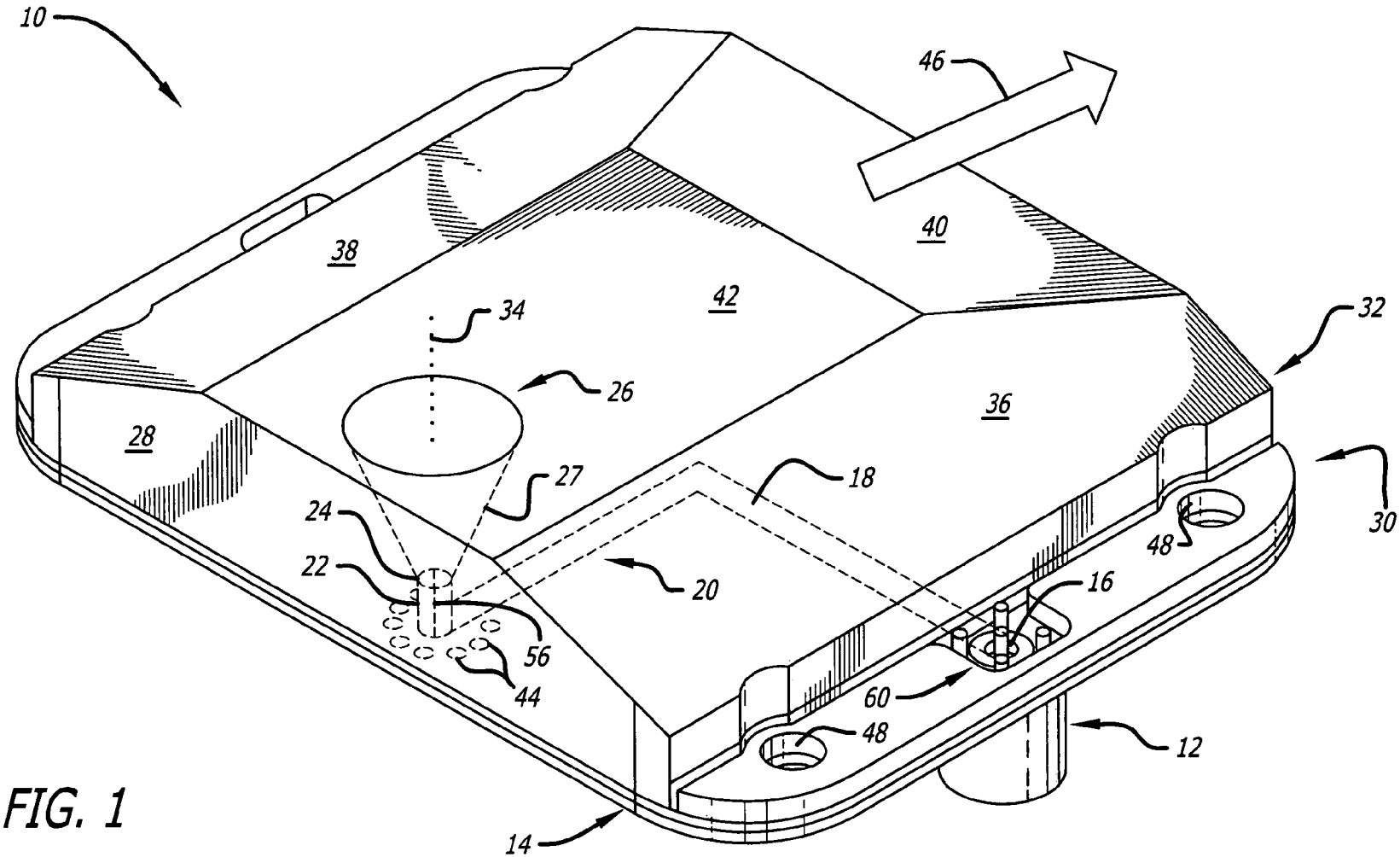
FIG. 1 is a diagram of a compact broadband antenna according to an embodiment of the present invention.

FIG. 1 is a diagram of a compact broadband antenna 10 according to an embodiment of the present invention. For clarity, various features, such as power supplies, frequency generators, network analyzers, and so on, have been omitted from the figures. However, those skilled in the art with access to the present teachings will know which components and features to implement and how to implement them to meet the needs of a given application.

The compact broadband antenna 10 includes a input coaxial connector 12 that is connected to base layer sections 14 via connector pins 60, which include a coaxial-to-stripline center conductor transition 16 to a stripline center conductor 18. The base layer sections 14 accommodate a stripline transmission line having the center conductor 18. The stripline transmission line center conductor 18 is coupled to a coaxial feed transmission line, 22, which together form a feed network 20. The coaxial feed transmission line 22 is coupled to a vertex 24 of a conical antenna element 26, which is strategically positioned adjacent to a back-reflector 28. The antenna element 26 has selectively angled sidewalls 27, which provide an efficient radiating surface.

The feed network 20, conical antenna element 26, and back-reflector 28 are supported by various layer sections 30, which include support layers, bond layers, and dielectric layers, including a top chamfered dielectric 32, and the base layer sections 14, as discussed more fully below. Those skilled in the art will appreciate that while the conical antenna element 26 is employed as a radiating element in the present embodiment, the element 26 may act as a receiving element and/or a transmitting element, depending on the application.

In the present specific embodiment, the conical antenna element 26 is oriented relative to the back-reflector 28 and the various layer sections 30 so that a longitudinal axis 34 of the conical antenna element 26 is approximately perpendicular to the various layer sections 30 and parallel to the surface of the back-reflector 28.

The top chamfered dielectric 32 includes various facets 36-42 including a right facet 36, a left facet 38, an output facet 40, and the top facet 42. The various facets 36-42 enhance the compact form factor of the broadband antenna 10 and may facilitate beam shaping. Beam shaping, mode selection, and broadband performance are further facilitated by strategic selection of layer sections 30, including dielectric layer sections, as discussed more fully below. Beam mode selection is also facilitated by features of the feed network 20, including mode-suppression holes 44, which are positioned through the layer sections 30 and strategically placed about the coaxial feed transmission line 22 that feeds the conical antenna element 26. In the present specific embodiment, the through holes 44 are separated by approximately 30° of angular separation. The mode-suppression holes 44 may facilitate tuning the antenna 10 so that the resulting radiation pattern includes a lobe that extends forward in the direction of a beam 46. Additional mounting holes 48 are positioned in the base layer sections 14 to facilitate mounting the antenna 10. The mounting holes 48 are positioned to minimize their effect on the output beam 46.

Those skilled in the art will appreciate that the exact dimensions and angles of the facets 36-42 are application-specific and may be determined by those skilled in the art to meet the needs of a given application without undue experimentation. Furthermore, the facets 36-42 may be vertical facets without departing from the scope of the present invention. In the present embodiment, the side facets 36, 38 are beveled at approximately 22.4°, while front facet is angled approximately 10.4° relative to the top surface 42.

In operation, electromagnetic energy of a desired frequency is input to the stripline transmission line formed by the center conductor 18 via the input coaxial connector 12. Input electromagnetic energy propagates along the stripline center conductor 18 between groundplanes formed via the layers 14 and then couples to the coaxial feed transmission line 22. The energy then propagates from the coaxial feed transmission line 22 to the conical antenna element 26. As the input electromagnetic energy propagates through the feed network 20 and to the conical antenna element 26, various features, such as the mode-suppression holes 44, and dielectric constants of the layer sections 30 facilitate tuning of the electromagnetic energy in preparation for transmission from the conical antenna element 26.

When the electromagnetic energy reaches the conical antenna element 26, the energy radiates from the angled surface 27, which is angled approximately 27° relative to the longitudinal axis 34 in the present embodiment. Partially due to the back-reflector 28 and the beam-shaping effects of the layered sections 30, including the top chamfered dielectric section 32, most energy will radiate forward from the output facet 40, forming a directional output beam 46. The output beam 46 propagates in a direction that is approximately perpendicular to the longitudinal axis 34 of the conical antenna element 34.

By strategically positioning the back-reflector 28 relative to conical antenna element 26 and by selecting appropriate element 26 and reflector 28 dimensions for a particular application and input frequency, additional gain is achieved. Appropriate use of the back-reflector 28 may result in gains of 5 dBi or greater, as energy propagating backward from the conical antenna element 26 is reflected forward, combining in phase with energy 46 radiating forward from the conical antenna element 26. The peak of the resulting beam 46 is forward of the compact broadband antenna 10.

In the present specific embodiment, the back-reflector 28 is formed from a flat plate of nickel and/or copper or is painted or plated with a silver layer. The back-reflector 28 is cut so that edges of the back-reflector 28 align with the right chamfered facet 36 and the left chamfered facet 38 of the top dielectric layer 32. The back-reflector 28 may be another shape other than flat without departing from the scope of the present invention. For example, the back-reflector 28 may be curved, such as parabolic-shaped and oriented so that the parabola opens in the direction of the conical antenna element 26 to facilitate focusing electromagnetic energy forward of the antenna 10.

The conical antenna element 26 is substantially hollow or solid and may be constructed via well-known lithographic techniques. For example, a conic depression may be formed in the layers 30 and then plated with nickel or painted with a silver metallic conductive paint. Alternatively, the conical antenna element 26 is solid, such as solid copper. The conical antenna element 26 may be another shape. For example, the element 26 may have parabolic or trapezoidal vertical cross-section or a multi-faceted horizontal cross-section, without departing from the scope of the present invention. Use of a cone or other appropriate antenna element that increases in diameter from the input end 24 to a top surface 42 as a primary radiation source may provide greater bandwidth than conventional antennas used to create directional beams.

In some implementations, the coaxial feed transmission line 22 may be omitted, and instead, the conical antenna element 26 may directly couple to the stripline center conductor 18, without departing from the scope of the present invention. Furthermore, various features of the feed network 20, including the stripline 18, the input coaxial connector 12, and mode-suppression holes 44 are application-specific and may be modified, omitted, or replaced by other types of feed networks to meet the needs of a given application without departing from the scope of the present invention.

Electric fields radiate radially outward from the center conductor 56 and terminate on the mode-suppression holes 44, which occurs when current is flowing up the center conductor 56. However, this only occurs where mode-suppression holes 44 are present in layers. As the fields reach layers 62-70 and 32, the electric fields begin to expand into the dielectric regions (see layer 32) and are shaped by those dielectrics and by bouncing off the plated back wall 28 of the top chamfered dielectric section 32 until they collimate and exit the antenna 10 as the beam 46. Furthermore, in the present embodiment, the mode-suppression holes 44 are spaced such that gaps between them are much smaller than 1/10 of a wavelength.

While transmit operations of the broadband antenna 10 are discussed with reference to FIG. 1, those skilled in the art will appreciate that the broadband antenna 10 may also be employed for receive functions.

Figure 2:
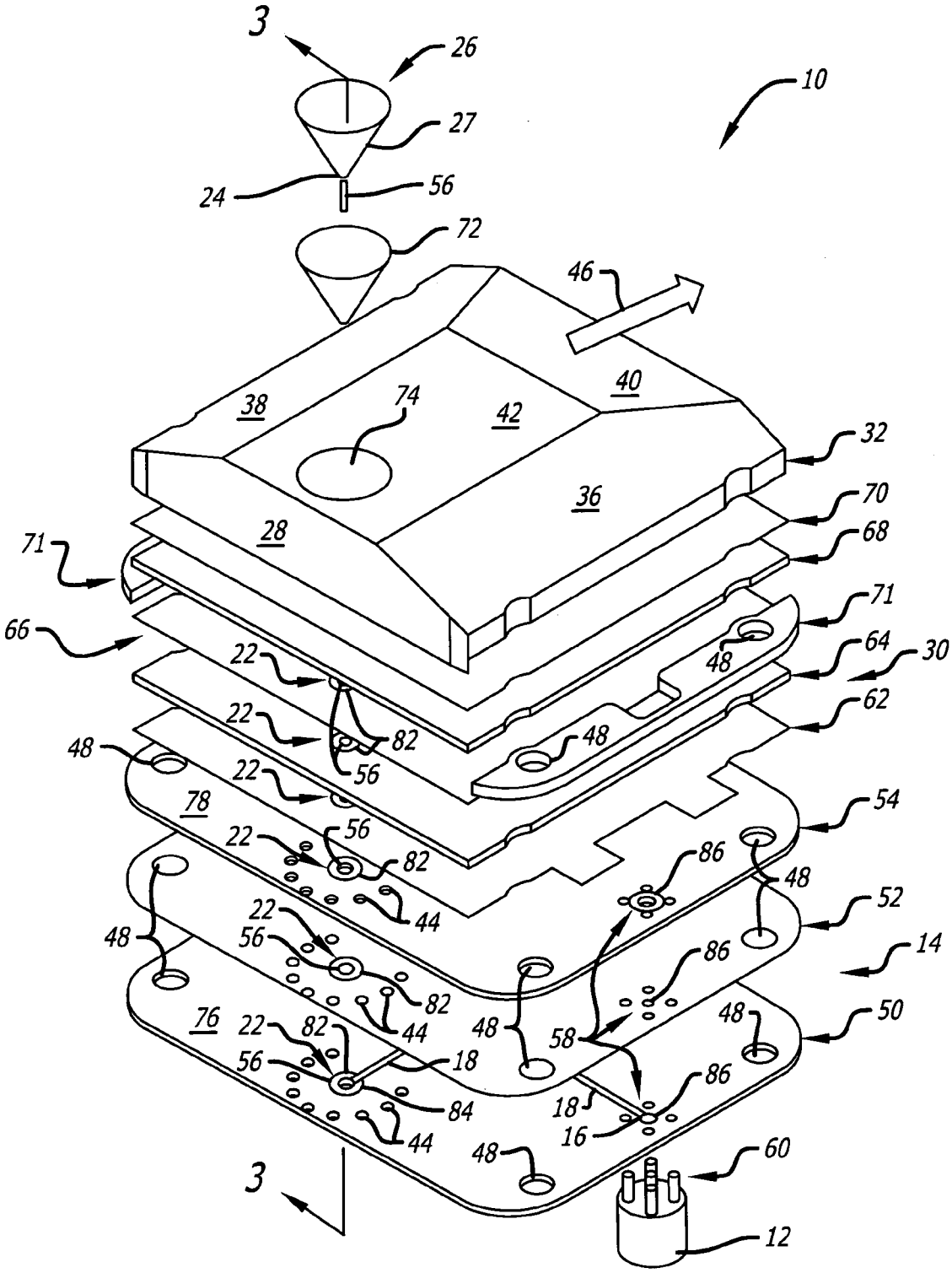
FIG. 2 is a more detailed exploded view of the compact broadband antenna of FIG. 1.

FIG. 2 is a more detailed exploded view of the compact broadband antenna 10 of FIG. 1. The base layer sections 14 include a first layer section 50, a second layer section 52, and a third layer section 54. The first layer section 50 accommodates the stripline transmission line center conductor 18. The first layer section 50 includes a groundplane disposed on a bottom surface and the metallic stripline center conductor 18 disposed on a top surface 76 and supported by core dielectric material, as discussed more fully below. In the present specific embodiment, the core dielectric material is Rogers 3003 dielectric.

The mode-suppression holes 44 have plated walls, i.e., they are plated through-holes that extend through the first layer section 50 and are strategically placed about a center coaxial feed conductor 56, which terminates one end of the stripline transmission line center conductor 18. Another end of the stripline transmission line center conductor 18 terminates at coaxial connector holes 58. The coaxial connector holes 58 are designed to accommodate the input coaxial connector 12 and accompanying pins 60 so that energy from the coaxial connector 12 will efficiently couple to the stripline transmission line formed via the center conductor 18 and accompanying ground planes, as discussed more fully below.

The second layer section 52 acts as a bond layer and facilitates bonding the first layer section 50 to the third layer section 54. The second layer section 52 may be constructed from Dupont Bond Film (Part No. FEP 200 C-20). The second layer section 52 also includes the strategically placed through holes 44, which align with the corresponding through holes 44 in the first layer section 44 and the third layer section 54. The various base layer sections 14 (50-54) have coaxial connector holes 58, some of which are plated and some of which are not plated. Those skilled in the art will know which of the coaxial connector holes 58 to plate and which holes to leave clear without undue experimentation. Furthermore, the exact dimensions of the various antenna features, including mode-suppression holes 44, the thickness of the various layers 30, and so on, are application-specific and may be determined by one skilled in the art to meet the needs of a given application without undue experimentation.

The third layer section 54 includes a metallic groundplane top surface 78 and a bottom surface 92, which are supported by a dielectric core, as discussed more fully below. In the present specific embodiment, the dielectric core is Rogers 3003 dielectric, and the groundplane 78 is implemented via Rogers ElectroDeposited Copper (EDC) foil with nickel plating.

A fourth layer 62 acts as a bond layer between the third layer 54 and a fifth layer 64. The fifth layer 64 is a strategically-place dielectric layer that facilitates antenna tuning and associated broadband antenna performance and beam shaping. In the present specific embodiment, the fifth layer 64 is implemented via Rogers 3006 unclad dielectric. The fifth layer 64 is unclad, lacking any plating on top or bottom surfaces of the layer 64.

A sixth layer 66 acts as a bond layer and is positioned atop the fifth layer 64 and beneath a seventh layer 68. The bond layer 66 may be constructed from Rogers 3001 bond film. The seventh layer 68 is a second special dielectric layer that facilitates antenna tuning and associated broadband antenna performance. The seventh layer 68 may also be constructed from unclad Rogers 3006 dielectric.

An eighth layer 70 acts as a bond layer and is positioned atop the seventh dielectric layer 68 and beneath the top chamfered dielectric 32. The eighth layer 70 may be implemented via Rogers 3001 bond film. The ninth layer, corresponding to the top chamfered dielectric 32, is implemented via Rogers TMM4 unclad dielectric in the present specific embodiment. A tenth layer 71 acts as a stiffening structure and is positioned atop the fifth layer 64 and adjacent to the seventh layer 68 and the tenth layer 71. The stiffening tenth layer 71 may be constructed of aluminum or various materials known in the art. Additional stiffening layers may be added or removed from the antenna 10 without departing from the scope of the present invention.

In the present specific embodiment, an electrically conductive adhesive 72, such as Ablebond™, is employed to secure the conic antenna element 26 in a conical hole 74 in the top chamfered dielectric 32. The conical antenna element 26 is shown connected to the coaxial feed transmission line center conductor 56. The coaxial feed transmission line center conductor 56 and the conical antenna element 26 may be implemented as one piece, wherein the center conductor 56 of the coaxial feed transmission line is bonded to an input end, i.e., vertex end 24 of the conical antenna element 72. The coaxial feed transmission line center conductor 56 extends through the various layers 30 and couples to the stripline transmission line center conductor 18 at the center coaxial feed transmission line conductor 56 in the first layer 50. The mode suppression holes 44 only extend through the base layer sections 14.

Figure 3:
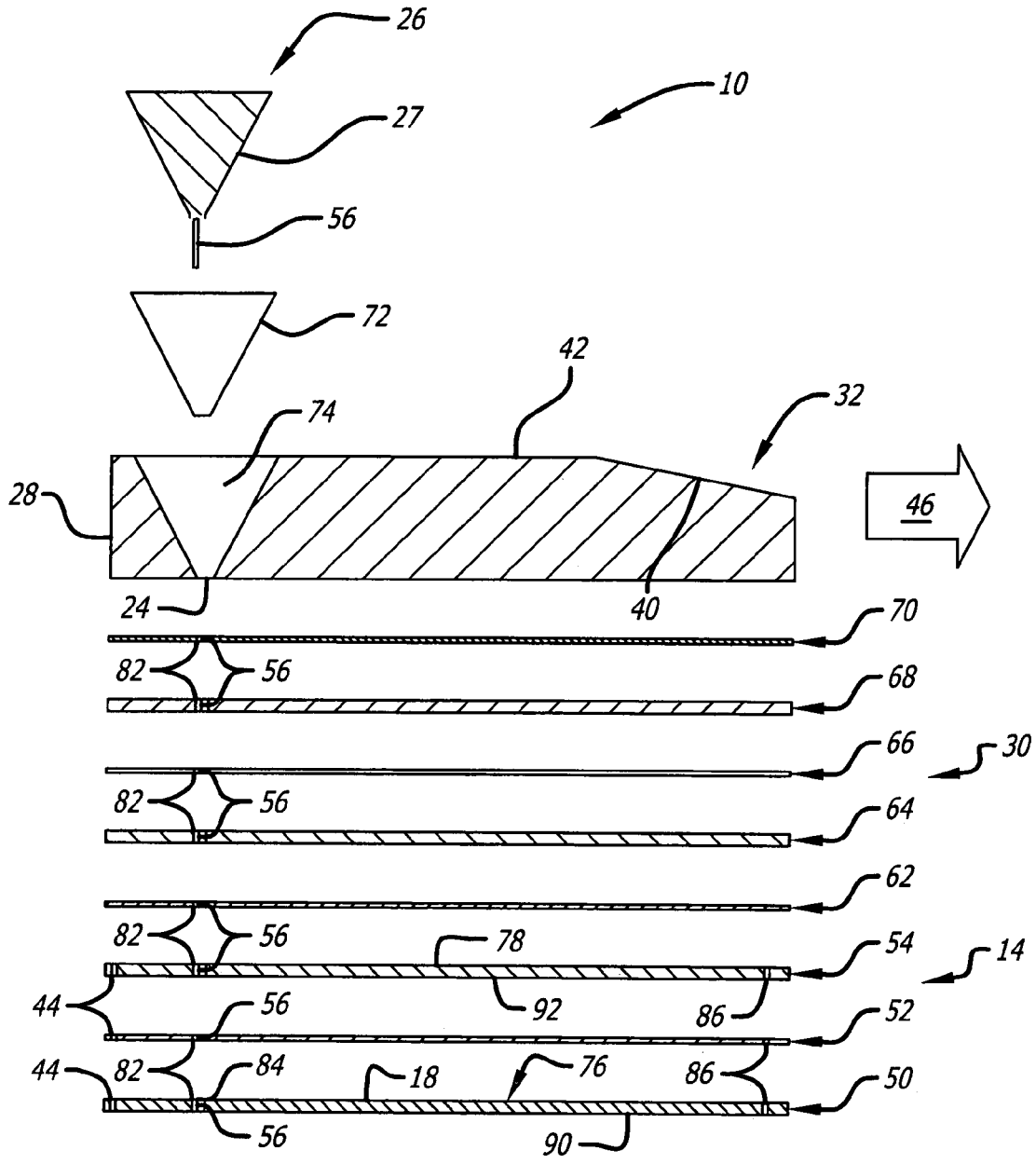
FIG. 3 is an exploded cross-sectional view of the compact broadband antenna of FIG. 2.

FIG. 3 is an exploded cross-sectional view of the compact broadband antenna 10 of FIG. 2. The first layer section 50 includes a first stripline groundplane surface 90 and a top center stripline conductor surface 76. The first stripline groundplane surface 90 is constructed from a metal, such as nickel-plated copper. The top center stripline conductor surface 76 is primarily dielectric material, but includes the conductive stripline center conductor 18 of FIG. 2, which may be made from copper. The stripline surfaces 76, 90 are supported by a dielectric core, which may be constructed from Rogers 3003 dielectric.

The third layer section 54 includes the conductive groundplane surface 78, which is implemented via nickel-plated copper in the present embodiment. The ground plane surface 78 is formed on a dielectric core, which also provides the bottom surface 92 of the third layer section 54.

The fifth layer 64, seventh layer 66, and the ninth chamfered dielectric layer 32, which are separated by bonding layers 66, 70, represent layered dielectrics that facilitate beam-shaping and antenna tuning. Layer thickness and dielectric constants may be adjusted by those skilled in the art to meet the needs of a given application without undue experimentation.

In the present specific embodiment, the fifth layer section 64 and the seventh layer section 68 are approximately 0.025 inches thick. The chamfered dielectric layer 32 is approximately 0.26 inches thick. The longitudinal axis 34, which corresponds to the centerline of the radiating element 2, is positioned approximately 0.2 inches from the metallic back-reflector 28.

The conical hole 74, which accommodates the adhesive 72 and conical antenna element 26 has sidewalls that are angled approximately 27° relative to the longitudinal axis 34 of the antenna element 26. In the present embodiment, the groundplanes 90, 78 are at least 0.0015 inches thick copper with a nickel overplate that is that is approximately 150 microinches thick.

The various transmission line feed holes that accommodate the center conductor 56 and outer conductor 82 may include padding or dielectric to facilitate accommodating the coaxial feed transmission line (see 22 of FIG. 1) formed by the outer conductor 82 and center conductor 56. The exact type of padding or dielectric is application-specific and may be omitted without departing from the scope of the present invention.

Figure 4:
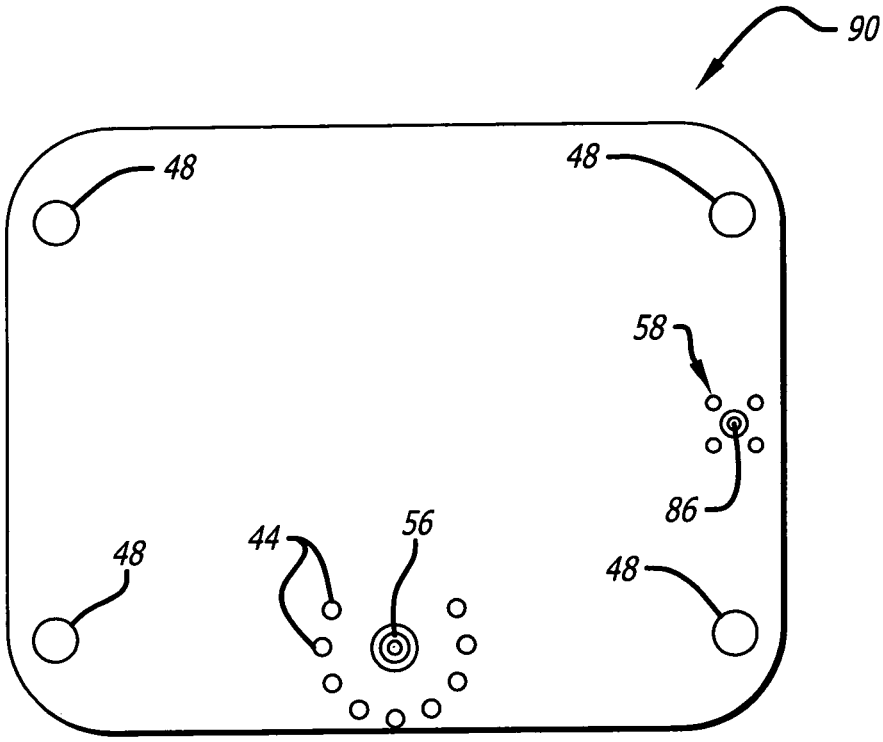
FIG. 4 shows the bottom stripline groundplane surface of the first layer section of the compact broadband antenna of FIG. 2.

FIG. 4 shows the bottom stripline groundplane surface 90 of the first layer section 50 of the compact broadband antenna 10 of FIG. 2. The bottom groundplane surface 90 includes the plated mode-suppression holes 44, which are partially distributed about the center coaxial feed section 22, which shows a cross-section of the inner coaxial feed conductor 56 that passes through the outer coaxial feed conductor, which is implemented via the groundplane 90. The bottom groundplane surface 90 also includes coaxial connector holes 58 for accommodating a standard coaxial cable connector and accompanying pins 60, which may be implemented via a Corning GPO RF connector, part No. A008-L35-02. The coaxial connector holes 58 include a center hole 86 that accommodates a center conductor of the input coaxial connector 12 of FIGS. 1 and 2. In the present embodiment, the groundplane surface 90 is implemented via 0.0015 inch thick copper that is overplated with nickel that is at least 150 microinches thick.

Figure 5:
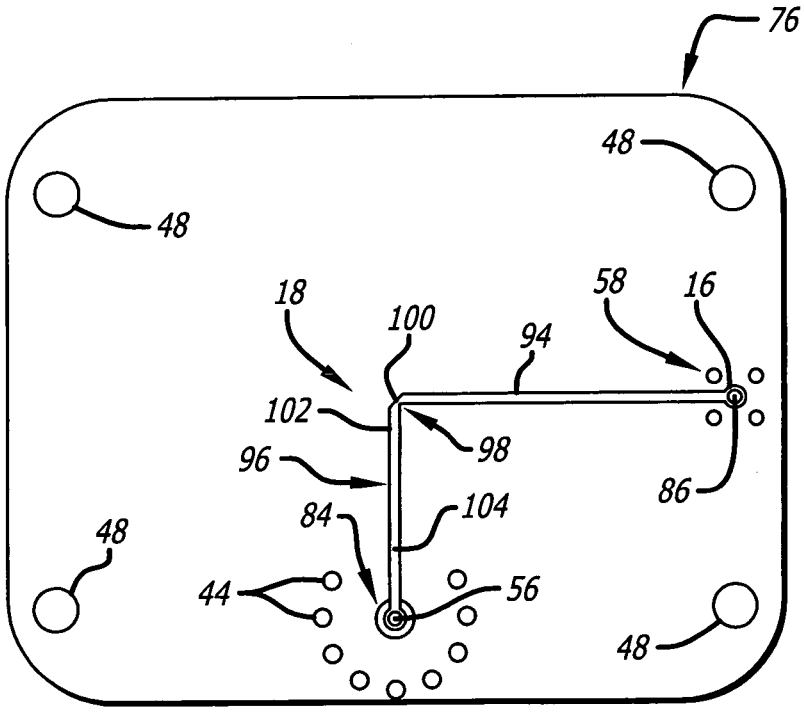
FIG. 5 shows the top surface of the first layer section of the compact broadband antenna of FIG. 2.

FIG. 5 shows the top surface 76 of the first layer section 50 of the compact broadband antenna 10 of FIG. 2. The top surface 76 includes the stripline center conductor 18 that connects to a center coaxial cable connector (see center pin of pins 60 of FIG. 1) at the center coaxial connector hole 86 at the coaxial-to-stripline center conductor transition 16. The stripline center conductor 18 connects to the center conductor 56 of the coaxial feed transmission line 22 at a stripline-to-coaxial center conductor transition 84.

The stripline center conductor 18 includes a first leg 94 that connects to a telescoping leg 96 at a ninety-degree bend 98 having a forty-five degree bevel 100. The telescoping leg 96 includes a wider section 102 that extends into a narrower section 104. In the present specific embodiment, the first leg 94 and the wider section 102 of the telescoping leg 96 are approximately 0.026 inches wide, while the narrower section 104 is approximately 0.021 inches wide. The telescoping section 96 facilitates antenna tuning.

Figure 6:
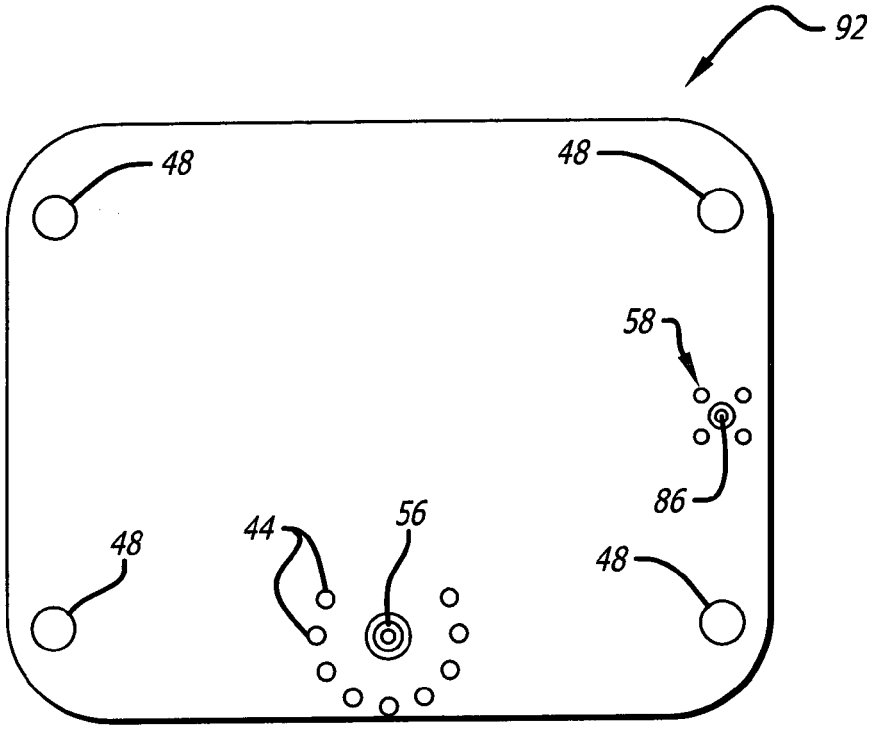
FIG. 6 shows the bottom surface of the third layer section of the compact broadband antenna of FIG. 2.

FIG. 6 shows the bottom surface 92 of the third layer section 54 of the compact broadband antenna 10 of FIG. 2. The bottom surface 92 includes the metal-walled mode-suppression holes 44 and the coaxial feed transmission line section 22 with the inner conductor 56. The surface 92 also accommodates the coaxial connector 58.

Figure 7:
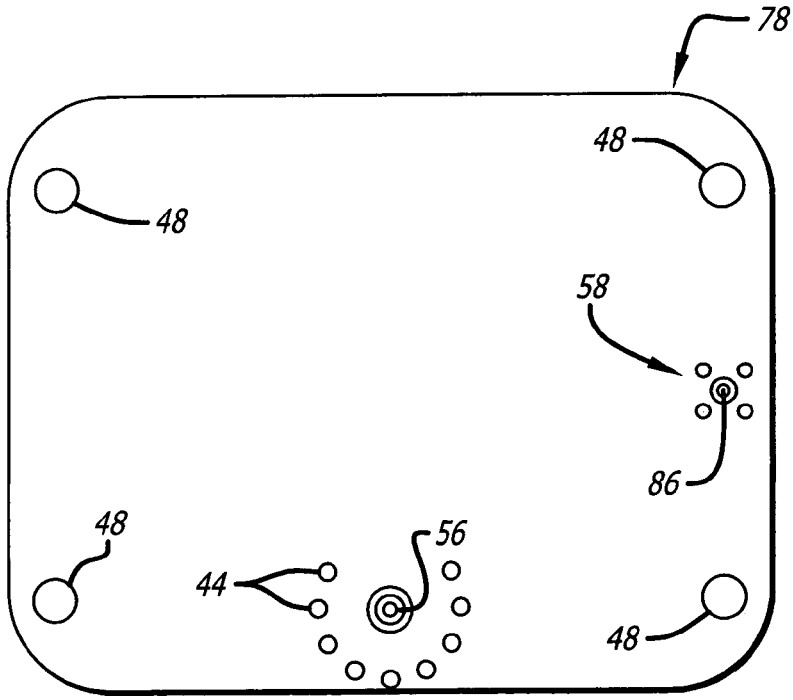
FIG. 7 shows the top stripline groundplane surface of the third layer section of the compact broadband antenna of FIG. 2.

FIG. 7 shows the top groundplane surface 78 of the third layer section 54 of the compact broadband antenna 10 of FIG. 2. The coaxial connector holes 58 and the mode-suppression holes 44 terminate at the top groundplane surface 78. The coaxial feed section 22 extends through the surface 78 to the top chamfered dielectric 32 of FIG. 2, where it terminates. The center conductor 56 extends partially into the conical antenna element 26 or is bonded to the vertex of the conical antenna element 26 in implementations wherein the conical antenna element 26 is solid or is substantially hollow.

Figure 8:
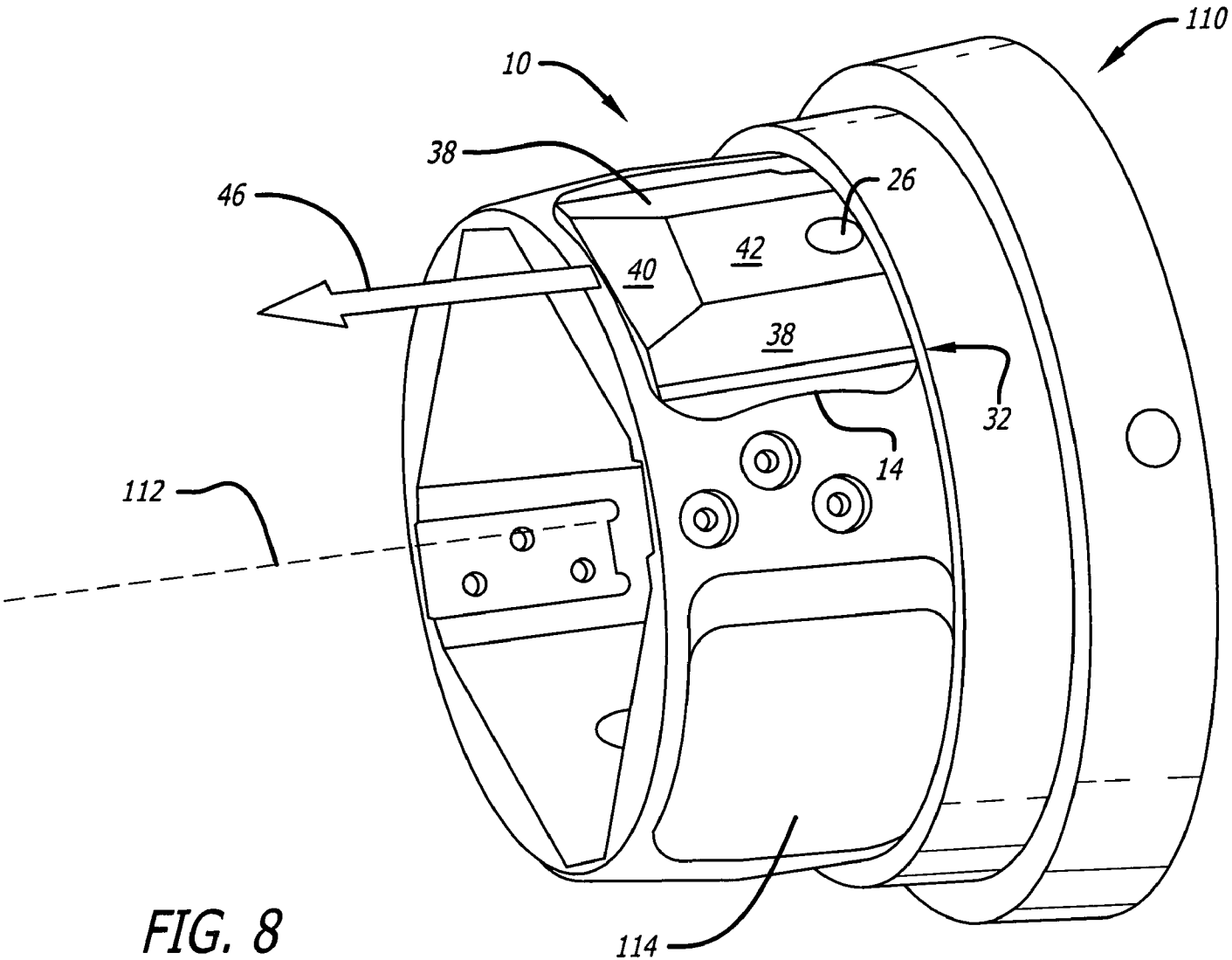
FIG. 8 is a diagram of an exemplary mounting system adapted for use with the compact broadband antenna of FIG. 2.

FIG. 8 is a diagram of an exemplary mounting system 110 adapted for use with the compact broadband antenna 10 of FIG. 2. The antenna 10 is mounted to a surface of the mounting system 110 and oriented so that energy 46 from the antenna 10 emanates forward and approximately parallel to a system longitudinal axis 112. The mounting system 110 may also accommodate other antennas, such as a Global Positioning System (GPS) antenna 114. The mounting system 110 represents the front end of a projected munition with its radome cover removed.

In various embodiments disclosed herein, Rogers materials were selected for their ability to withstand temperature without losing thermal stability, hence alleviating concerns that the antenna would expand unduly with heat and thereby de-tune the antenna. The effects of G-forces are further alleviated with the aluminum stiffeners (see 71 of FIG. 2).

Those skilled in the art will appreciate that the antenna 10 of FIGS. 1 and 2 may be caused to operate at a lower or higher frequency by scaling all components in size while maintaining component aspect ratios.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. A compact broadband antenna comprising:

first means for receiving input electromagnetic energy;

second means for providing radiated electromagnetic energy upon receipt of said input electromagnetic energy, said radiated electromagnetic energy provided via a conical antenna element; and third means for directing said radiated electromagnetic energy in a specific direction, said third means including a back-reflector selectively positioned behind said second means whereby a longitudinal axis of said antenna element is approximately parallel to said back-reflector to reflect back-radiated energy forward of said second means, thereby causing reflected electromagnetic energy to combine in phase with forward-radiated energy from said second means.

2. The system of claim 1 wherein said third means further includes plural layers of dielectric material.

3. The system of claim 2 wherein one or more of said plural layers of dielectric material partially surround an angled radiating surface of said second means.

4. The system of claim 1 wherein said conical antenna element is supported by and partially surrounded by a first layer of dielectric material.

5. The system of claim 4 wherein a top portion of said conical antenna element lacks dielectric material.

6. The system of claim 4 wherein said first layer of dielectric material includes one or more beveled surfaces.

7. The system of claim 4 wherein said first means includes an antenna feed having an input stripline transmission line that is coupled to a coaxial feed transmission line or wire, which is coupled to a vertex of said conical antenna element.

8. The system of claim 7 wherein said stripline transmission line includes a center conductor having a tapered section.

9. The system of claim 8 wherein said stripline transmission line includes dielectric material between a top ground plane and a bottom ground plane, said dielectric material accommodating a stripline center conductor.

10. The system of claim 9 wherein said dielectric material between said top ground plane and said bottom ground plane include antenna tuning holes therethrough.

11. The system of claim 10 wherein said antenna tuning holes partially surround a transition between said stripline center conductor and said coaxial feed transmission line or wire.

12. The system of claim 9 further including a second dielectric layer between said top ground plane and said first dielectric layer.

13. The system of claim 7 further including a mounting system upon which said antenna is mounted, said mounting system having a longitudinal axis that is approximately parallel to radiation transmitted by said antenna.

14. The system of claim 1 wherein said back-reflector is positioned relative to said conical element to produce a directional beam.

15. A compact broadband antenna comprising:

an antenna feed;

a substantially conical antenna element in communication with said antenna feed;

one or more layered dielectrics supporting said conical antenna element and accommodating said antenna feed; and a back-reflector having a reflecting surface positioned approximately parallel to a longitudinal axis of said conical antenna element and facing forward of said antenna.

16. The system of claim 15 wherein said one or more layered dielectrics include one or more antenna-tuning holes therethrough.

17. The system of claim 16 wherein said antenna feed includes a coaxial feed transmission line that connects to a vertex of said conical antenna element.

18. The system of claim 17 wherein said antenna feed includes a stripline transmission line supported by one or more of said layered dielectrics, said stripline transmission line connected between an input transmission line and said coaxial feed transmission line.

19. A compact directional antenna comprising:

a conical antenna element having longitudinal axis;

an antenna feed section connected to a feed end of said antenna element;

a structure positioned relative to said antenna element, said structure facilitating directing a transmit beam in a direction having a component perpendicular to said longitudinal axis in response to a feed signal input to said antenna feed section; and a back-reflector having a surface that is approximately parallel to said longitudinal axis of said antenna element.

20. The system of claim 19 wherein said antenna element has a diameter that increases in diameter from a feed end of said antenna element to an open end of said antenna element.

21. The system of claim 20 wherein said antenna element is approximately symmetric about said longitudinal axis.

22. The system of claim 20 wherein said antenna element includes conductive walls that are supported by dielectric material.

23. The system of claim 22 wherein said back-reflector is supported by said dielectric material.

24. The system of claim 23 wherein said dielectric material includes a blend of layered dielectrics sufficient to facilitate antenna tuning within a desired band and to facilitate directing said beam in desired direction.

25. The system of claim 23 wherein said antenna element includes a solid conical structure.

26. The system of claim 25 wherein said solid conical structure includes copper.

27. The system of claim 23 wherein said antenna element includes a hollow conical structure having said feed end near a vertex of said hollow conical structure and said open end at an opposite end of said hollow conical structure.

28. The system of claim 27 wherein said conical structure includes nickel-plated and/or copper surfaces.

29. The system of claim 27 wherein said back-reflector includes nickel-plated and/or copper surfaces.

30. The system of claim 27 wherein said antenna feed includes a coaxial-to-stripline transition positioned on a first feed layer.

31. The system of claim 30 further including one or more additional layers positioned on top of said first feed layer, said one or more additional layers having one or more holes therein sufficient to couple electromagnetic energy from a stripline to said antenna element.

32. The system of claim 31 wherein said one or more additional layers include one or more dielectric layers.

33. The system of claim 32 further including a mounting system upon which said antenna is mounted, said antenna mounted so that a beveled output facet of said antenna forward toward a nose of said mounting system and approximately parallel to a longitudinal axis of said mounting system.

34. A method for radiating electromagnetic energy comprising the steps of:

receiving input electromagnetic energy;

providing radiated electromagnetic energy upon receipt of said input electromagnetic energy, said radiated electromagnetic energy provided via a unitary antenna element having a diameter that increases from a feed end to an open end thereof; and directing said radiated electromagnetic energy in a predetermined direction with a back-reflector having a reflecting surface position approximately parallel to a longitudinal axis of said antenna element and facing forward relative thereto.

35. A compact broadband antenna comprising:

first means for receiving input electromagnetic energy;

second means for providing radiated electromagnetic energy upon receipt of said input electromagnetic energy, said radiated electromagnetic energy provided via a unitary antenna element having a diameter that increases from a feed end to an open end thereof;

third means for directing said radiated electromagnetic energy in a specific direction, said third means including a back-reflector mounted to reflect energy radiated from said antenna element in a direction normal to a longitudinal axis thereof.

36. The invention of claim 35 wherein said antenna element is conical.

37. The invention of claim 35 wherein said antenna element is hollow.

* * * * *